United States Patent [19]

Heltzel

[11] Patent Number: 4,682,435

[45] **Date of Patent: * Jul. 28, 1987**

[54] SAFETY SYSTEM FOR DISABLING A FIREARM

[76] Inventor: James Heltzel, Rte. 1, Box 351, Mauertown, Va. 22644

[ * ] Notice: The portion of the term of this patent subsequent to Jan. 14, 2003 has been disclaimed.

[21] Appl. No.: 839,616

[22] Filed: Mar. 14, 1986

[51] Int. Cl.[4] ..... F41C 17/00; F41C 17/04

[52] U.S. Cl. ..... 42/70.01; 42/70.11; 89/27.12

[58] Field of Search ..... 42/70.11, 70.01, 70.04, 42/70.05, 70.06, 66; 89/28.05, 27.12

[56] References Cited

U.S. PATENT DOCUMENTS

| | | | |
|---|---|---|---|
| 935,102 | 9/1909 | Fyrberg | 42/66 |
| 2,856,717 | 10/1958 | Parke | 42/70.01 |
| 3,157,958 | 11/1964 | Lewis | 42/66 |
| 3,939,679 | 2/1976 | Barker et al. | 42/70.01 |
| 4,090,316 | 5/1978 | Volkmar | 42/70.08 |
| 4,457,091 | 7/1984 | Wallerstein | 42/70.11 |
| 4,488,370 | 12/1984 | Lemelson | 42/70.01 |
| 4,563,827 | 1/1986 | Heltzel | 42/70.01 |

*Primary Examiner*—Deborah L. Kyle
*Assistant Examiner*—Michael J. Carone
*Attorney, Agent, or Firm*—Larson and Taylor

[57] ABSTRACT

A safety system for selectively disabling a firearm is disclosed. The firearm includes a mechanical linkage by which the firearm is fired by movement of a trigger, with the mechanical linkage including a link element. The link element is suitably mounted for movement between a position where the mechanical linkage is interrupted and a position where the mechanical linkage is functional. A link moving device for moving the link element between the interruped position and functional position is also provided with the link moving device normally biased to move the link element and hold the link element in the functional position. A remotely controlled actuating device for actuating the link moving device includes a transmitter designed to be carried by the operator of the firearm and a receiver adapted to be mounted in the handle of the firearm. The link member is conveniently a firing pin and/or a trigger bar. Once activated, the safety system is designed to be deactivated either by the absence of the activation signal or a new enabling signal.

9 Claims, 3 Drawing Figures

ENABLE
TO ENCODER
DISABLE
82a'
82b'
82c'
72'
74'

70
OSCILLATOR
76
MODULATOR
78
ENCODER
80
(TRANSMITTER)
82a
82b
82c
SWITCH
74
72
62
RECEIVING MODULE
64
DECODER
66
SOLENOID AMPLIFIER
68
(RECEIVER)
36
50, 40
SOLENOID

SAFETY SYSTEM FOR DISABLING A FIREARM

FIELD OF THE INVENTION

The present invention relates generally to a safety system for a firearm, and more particularly to a safety system for selectively disabling a firearm by use of a remote transmitter.

BACKGROUND OF THE INVENTION

A number of prior art devices have been disclosed which relate to safety systems for firearms. For example, in U.S. Pat. No. 4,003,152 (Barker et al) a safety system is described in which a firearm is normally disabled. The firearm is enabled only when a coded signal is transmitted by an authorized person. In U.S. Pat. No. 3,400,393 (Ash), a weapon safety system is disclosed in which weapons have mounted thereon an electromagnetic wave transceiver. Each weapon is disabled if it is pointed at and detects identical electromagnetic waves transmitted by another weapon with the same transceiver. If no identical electromagnetic wave is received, the weapon is functional. A similar safety system is disclosed in U.S. Pat. No. 2,472,136 (Whitlock). A safety system in which a plurality of weapons can fire only when the weapon trigger is depressed and a specific command signal is received by the weapon is disclosed in U.S. Pat. No. 4,205,589 (Engler et al).

In applicant's prior U.S. Pat. No. 4,563,827 issued Jan. 14, 1986 a safety system for selectively disabling a firearm is disclosed. The safety system includes a block which is moved to block the mechanical firing movement. This safety system is activated by a remote control device and is deactivated when the activation signal ceases.

SUMMARY OF THE INVENTION

In accordance with the present invention, a safety system for selectively disabling a firearm is provided. The safety system includes a mechanical linkage by which the firearm is fired by movement of the trigger, with this mechanical linkage including a specified link element. A link mounting means is then provided for mounting this link element for movement between a position wherein the mechanical linkage is interruped and a position wherein the mechanical linkage is functional. A link moving means is further provided for moving the link element between the interruped position and the functional position. The link moving means is normally biased to move the link element to and hold the link element in the functional position. This safety system further includes a remotely controlled actuating means for actuating the link moving means. This actuating means includes a transmitter means for selectively transmitting a gun disabling signal. This transmitter means is designed to be carried by the authorized operator of the firearm. A receiver means is then located adjacent the link moving means for receiving the signal from the transmitter means and for operating the link moving means.

In one preferred embodiment of the present invention, the link member is the firing pin. In another embodiment, the link member is a trigger bar. If desired, both the firing pin and trigger bar could also be moved for a redundant interruption of the mechanical firing linkage.

Preferably, the transmitter means is designed to be easily activated by a push buttom. If desired, the transmitter means is additionally provided with a plurality of push buttons which must be pushed in a predetermined sequence to turn off the transmitter means after the transmitter means has been initially activated.

Alternatively, after the transmitter means is easily activated by a push button the link member remains in the interrupted position until a new signal is received by the receiver means to move the link member back to the functional position. If desired, the new enabling signal is provided by pushing a plurality of push buttoms in a predetermined sequence.

It is an object of the present invention to provide a safety system for disabling a firearm when desired. The safety system is normally biased to the position where the firearm is enabled, so that only a positive actuation of the transmitter means results in the firearm being disabled.

It is another object of the present invention to provide a safety system in which any malfunction in the transmitter means, receiver means, or moving means for the link element still allows the weapon to operate in the normal manner and not be disabled.

Still another object of the present invention is to provide a safety system in which a firearm is easily disabled and is maintained in the disabled position at all times thereafter unless a new enabling signal is received by the safety system.

It is a feature of the present invention that the safety system requires only a very low energy consumption, especially when the safety system is not activated.

Other objects, features, and advantages of the present invention are stated in or apparent from a detailed description of presently preferred embodiments of the invention found hereinbelow.

DETAILED DESCRIPTION OF THE PREFERRED EMBODIMENTS

Figure 1:
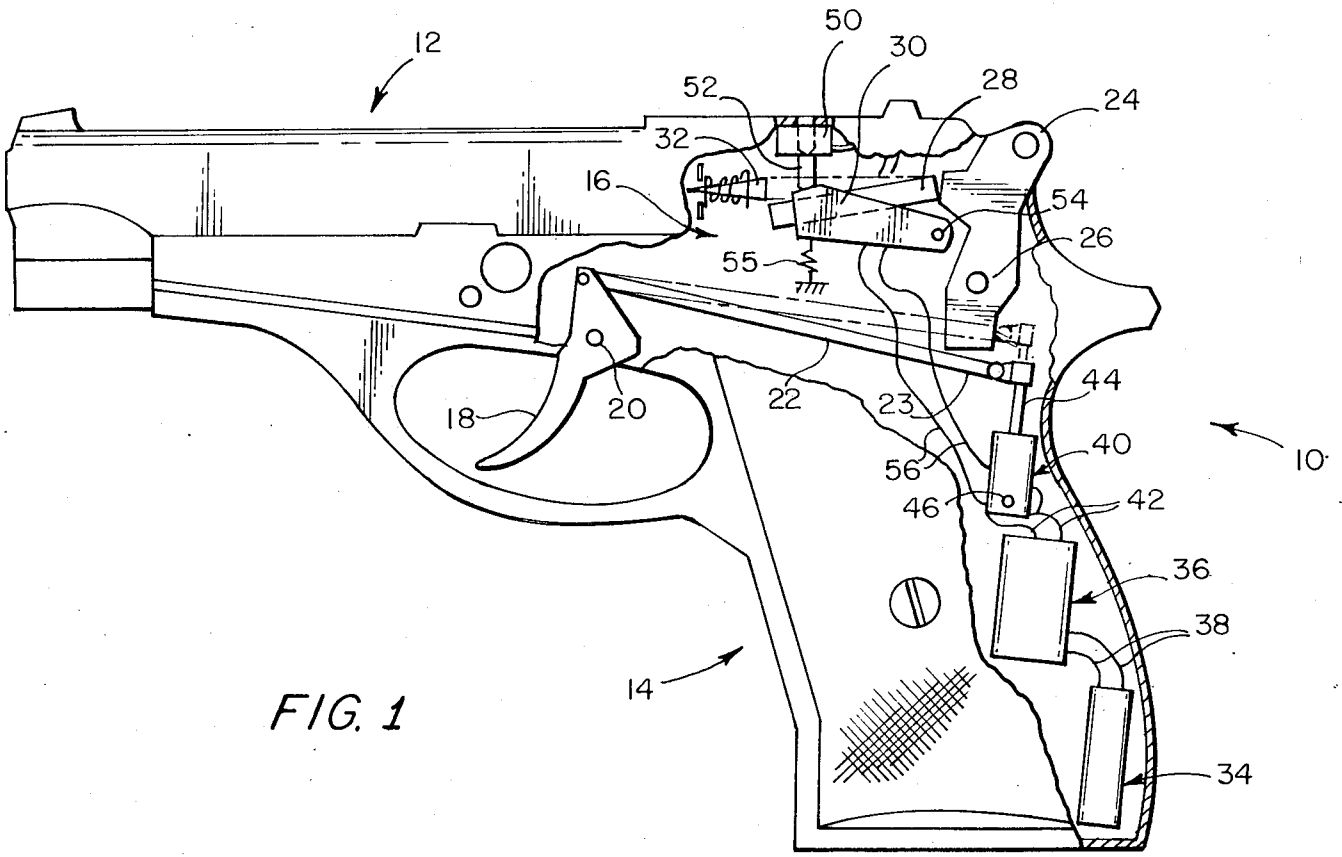
FIG. 1 is a side elevation view with portions cut away of a firearm including the safety system of the present invention.

With reference now to the drawings in which like numerals represent like elements throughout the several views, a safety system 10 for a handgun 12 is depicted in FIG. 1. Safety system 10 is incorporated in handle 14 of handgun 12. As shown, handgun 12 includes a mechanical linkage 16 by which handgun 12 is fired. Mechanical linkage 16 includes a trigger 18 which is movable about a pivot 20. One end 21 of trigger bar 22 is pivotally connected to trigger 18 as shown. The other end 23 of trigger bar 22 engages the lower end of a hammer 24. Hammer 24 pivots about a pivot 26. After hammer 24 is suitable cocked by a movement of trigger 18, hammer 24 contacts a firing pin extension 28 slidingly mounted in a firing pin extension carriage 30. Movement of firing pin extension 28 through firing pin extension carriage 30 and against firing pin 32 causes firing pin 32 to contact a cartridge mounted in the barrel of the gun to be fired. Mechanical linkage 16 is typical of handguns, and it should be appreciated that the present invention is suitable for incorporation in such typical mechanical linkages.

Also mounted in handle 14 of handgun 12 is a power supply 34 such as a battery. Power supply 34 supplies electrical power to receiving means 36 by wires 38. Receiving means 36 is then connected to a solenoid 40 by wires 42. Solenoid 40 includes a movable arm 44 which is connected to end 23 of trigger bar 22 adjacent hammer 24. Solenoid 40 is pivotally mounted to handle 14 about a pivot 46.

Safety system 10 alternatively or further includes a solenoid 50 attached to the top of handgun 12. Solenoid 50 includes a movable arm 52 extending downwards as shown. Movable arm 52 contacts firing pin extension carriage 30 adjacent firing pin 32. In this embodiment of safety system 10, firing pin extension carriage 30 has been constructed so as to be pivotally mounted about a pivot 54. A spring means 55 urges firing pin extension carriage 30 and movable arm 52 upwards to the functional position of firing pin extension 28. Solenoid 50 is connected to receiving means 36 through wires 56.

Figures 2, 3:
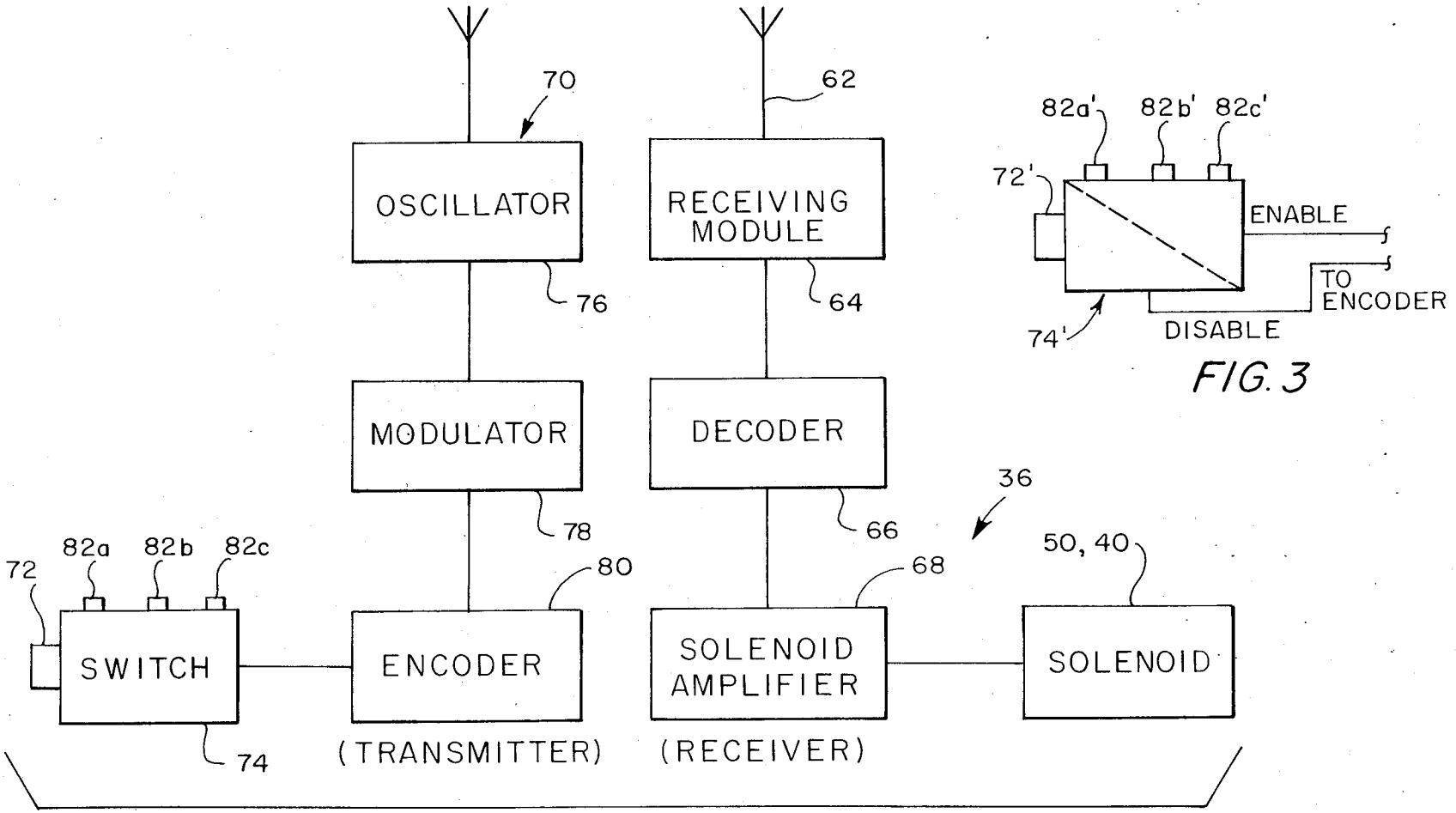
FIG. 2 is a schematic diagram of the transmitter and receiver units used with the safety system of the present invention.
FIG. 3 is an alternative switch element for the transmitter unit depicted in FIG. 2.

Safety system 10 further includes a remotely controlled actuating means 60 depicted in greater detail in FIG. 2. Actuating means 60 includes receiving means 36 mentioned above. As shown in FIG. 2, receiving means 36 includes an antenna 62, a receiving module 64, a decoder 66, and a solenoid amplifier 68.

Actuating means 60 also includes a transmitter means 70 which is also schematically depicted in FIG. 2. Transmitter means 70 is designed to be carried by the operator of handgun 12 and to include a simple push button 72 to activate switch 74 of transmitter means 70. Transmitter means 70 further includes an oscillator 76, a modulator 78, and an encoder 80. With these components, transmitter means 70 transmitts a suitable encoded signal upon activation which is suitable received by receiving means 36 and decoded to actuate solenoids 40 and/or 50.

If desired, switch 74 is provided with a plurality of push buttons 82*a*, 82*b*, and 82*c* which constitute a keyed lock means. Push buttons 82*a*, 82*b*, and 82*c* are suitably connected to a switching circuit so that transmitter means 70 cannot be deactivated after initial actuation by push button 72 until push buttons 82*a*, 82*b*, and 82*c* are sequentially pressed or keyed in a predetermined sequence. A push button unlocking circuit of this type is well known in the art and a circuit of this type is disclosed in U.S. Pat. No. 3,831,065 (Martin et al).

In operation, safety system 10 functions in the following manner. Initially, safety system 10 is in the position depicted in FIG. 1 as indicated by the dashed lines. Thus, trigger bar 22 is in the upper position engaging the rear portion of hammer 24. Similarly, firing pin extension 28 is aligned with hammer 24 and firing pin 32 as firing pin extension carriage 30 is pivoted to the upper position about pivot 54 by spring means 55. In this position, mechanical linkage 16 of handgun 12 is functional in the normal manner. At this time, receiving means 36 is energized by power supply 34 so that receiving module 64 is capable of receiving a signal from transmitter means 70 at all times. It should be appreciated that the energy required to maintain receiving means 36 in the "ready" condition is relatively small and that a rechargeable battery is a suitable power source. Preferably, handgun 12 is provided with a suitable circuit and plug-in charging device so that power supply 34 can be easily and regularly recharged by simply plugging handgun 12 into the charging device.

When it is desired to activate safety system 10, as for example when handgun 12 belongs to a police officer and an unauthorized user has gained control of handgun 12, the police officer merely presses push button 72 on transmitter means 70. Preferably, transmitter means 70 is carried by the police officer in such a position as to be easily actuated by the police officer. As soon as transmitter means 70 is actuated, an encoded signal is sent by transmitter means 70 to receiving means 36 where the signal is decoded by decoder 66. A signal from decoder 66 is then sent to solenoid amplifier 68 which in turn energizes solenoids 40 and/or 50.

As soon as solenoid 40 is energized, movable arm 44 thereof moves from the extended position depicted in dashed lines to the withdrawn position depicted in solid lines in FIG. 1. Similarly, trigger bar 22 moves from the position shown in dashed lines to the solid line position. In this position, mechanical linkage 16 is interrupted because movement of trigger 18 merely causes trigger bar 22 to move below hammer 24 without engagement of hammer 24. It should be appreciated that the back and forth movement of trigger bar 22 is allowed by the pivoting movement of solenoid 40 about pivot 46, both when mechanical linkage 16 is functional and non-functional.

Even when mechanical linkage 16 has been interrupted by the movement of trigger bar 22, it might still be possible to fire handgun 12 by manual movement of trigger 24. For this reason, firing pin extension carriage 30 is alternatively used in place of the movement of trigger 22 or in addition to the movement of trigger 22 as a redundant safety system. In the same manner that solenoid 40 was energized, solenoid 50 is similarly energized such that movable arm 52 moves from the withdrawn position depicted in dashed lines to the extended position depicted in solid lines. As this occurs, firing pin extension carriage 30 pivots about pivot 54 so that firing pin extension 28 moves from the position depicted in dashed lines to the position depicted in solid lines. In this position, the mechanical linkage between hammer 24 and firing pin 32 is interruped as firing pin extension 28 is no longer is position to contact firing pin 32 even though hammer 24 impacts thereon.

As long as transmitter means 70 is activated, solenoid 40 and/or 50 remains energized so as to render mechanical linkage 16 inoperable. Moreover, as soon as the police officer retrieves his handgun 12, transmitter means 70 can be immediately deactivated by the officer (if desired) by pushing push buttons 82*a*, 82*b*, and 82*c* in the necessary sequence to allow handgun 12 to again operate. When transmitter means 70 is turned off, solenoids 40 and/or 50 return to their inoperative positions depicted in dashed lines so that mechanical linkage 16 is again in the functional position. At this time, safety system 10 is again capable of being activated as soon as desired. However, if safety system 10 is actuated for a long period of time, power supply 34 should be recharged or replaced as appropriate.

It should be appreciated that safety system 10 is designed to be retrofitted to existing handguns 12. In addition, it should also be appreciated that the elements of safety system 10 are designed to fit in the hollow space provided in handle 14 of handgun 12.

Depicted in FIG. 3 is an alternative embodiment of a switch 74' usable in an alternative form of the present invention. With switch 74', the actuation of safety system 10 by push button 72' is substantially the same as that described above. However, whereas safety system 10 described above is deactivated by the absence of a signal from transmitter means 70, the alternative form of safety system 10 is such that safety system 10 is not deactivated until a new enabling signal is produced by switch 74'. With this alternative safety system, solenoids 40 and/or 50 remain in the position to interrupt mechanical linkage 16 until an enabling signal is transmitted from transmitter means 70. Thus, even if handgun 12 is removed from the range of transmitter means 70, handgun 12 remains disabled until an enabling signal is sent by switch 74'. In order to transmit an enabling signal, push buttons 82*a'*, 82*b'* and 82*c'* are similarly actuated in a predetermined sequence. Thus, with the reception of the enabling signal, handgun 12 is again in the operative condition and mechanical linkage 16 is functional.

It should be appreciated that the safety systems described above are designed to allow the handgun to operate in a normal manner until a disabling signal is received. Thus, even if power supply 34 is exhausted, handgun 12 still operates in the normal manner. However, as soon as transmitter means 70 is activated handgun 12 is immediately rendered disabled.

It should also be appreciated that the safety system of the present invention provides an easily concealed transmitter whereby the user need be the only one to know that a safety system is installed in the associated handgun. Thus, if the user should inadvertenly lose his weapon, the unauthorized person who retrieves the weapon would not immediately realize that the weapon was not capable of firing and would not also realize why the weapon was not capable of firing.

It should further be appreciated that the safety system of the present invention allows the weapon to be reactivated at the discretion of the user and only an authorized user where a keyed code switch is used. In addition, by use of a coded signal, only a specific transmitter transmitting a specified control signal will operate to inactivate the weapon. The use of solenoid also allows the operation of the safety system to be checked by merely activating the system and listening for the click of the solenoid action to indicate that the safety system is functioning properly.

When the safety system of the present invention is used with firearms of a police force, the transmitter means can also be adapted to notify a controller that an officer has found it necessary to deactivate his weapon and that a potentially dangerous situation has occurred. In this manner, help can be immediately sent.

If desired, an indicator on the weapon can also be provided to indicate when the safety system is engaged and use of the weapon is not possible. A small light or discrete audio signal are suitable as such indicators.

Although the present invention has been described with the use of a radio transmitter and receiver, it should be appreciated that other types of transmitters and receivers are possible. For example, sonic, ultrasonic and voice activated transmitters and receivers would also be possible.

In order to further conserve the battery power which is used to power the receiver means, a switch can be provided whereby the receiver is only powered to receive a transmitted signal when the switch is on. Such a switch could be manually activated whenever the user has call for concern that an unauthorized person might gain control of his weapon. Alternatively, a switch could be provided which would only power the receiver when the weapon is removed from a holster. A light switch, magnetic switch, spring loaded push-out switch, or other holster activated switch would be suitable for this purpose. Preferably, such a cut-off switch, once activated to supply power, would maintain the power for a set period of time so that no accidental or undesired return of the switch to the non-power delivering state would immediately cause the revolver to stop functioning.

Other suitable switches, could be activated by the position of the weapon. Thus, when the barrel is not vertically oriented, that is pointed to the ground as normally occurs when a weapon is carried in a holster or the like, the receiver would not be powered. Suitable switches of this type include magnetic and mercury position switches. A time switch could also be activated when the user carriers the weapon. In such case, the time switch would be activated for a period sufficient to cover the time period in which the user carries the weapon in a dangerous situation, such as the shift of a police officer.

While the present invention has been described with embodiments for temporarily disabling the firearm, it should also be appreciated that the solenoid described could be replaced by a fused link or other electromechanical device to permanently deactivate the weapon if desired.

Thus, while the present invention has been described with respect to exempliary embodiments thereof, it would be understood by those of ordinary skill in the art that variations and modifications can be effected within the scope and spirit of the invention.

I claim:

1. A safety system for selectively disabling a firearm comprising:

a mechanical linkage by which the firearm is fired by movement of a trigger, said mechanical linkage including a link element;

a link mounting means for mounting said link element for movement between a position wherein said mechanical linkage is interrupted and a position wherein said mechanical linkage is functional;

a link moving means for moving said link element between the interrupted position and the functional position, said moving means being normally biased to move said link element to and hold said link element in the functional position; and a remotely controlled actuating means for actuating said link moving means including (a) a transmitter means for selectively transmitting a disabling signal, said transmitter means being designed to be carried by the operator of the firearm, and (b) a receiver means located adjacent said link moving means for receiving the signal from said transmitter means and for operating said link moving means.

2. A safety system as claimed in claim 1 wherein said link moving means is a solenoid.

3. A safety system as claimed in claim 1 wherein said link member is a firing pin.

4. A safety system as claimed in claim 1 wherein said member is a trigger bar.

5. A safety system as claimed in claim 1 wherein said receiver means includes a cut-off switch for a battery which powers said receiver means.

6. A safety system as claimed in claim 1 wherein said actuating means includes a switch means which is easily actuated to activate said transmitter, said switch means including a keyed lock means for locking said transmitter in the activated condition until said keyed lock means is deactivated.

7. A safety system as claimed in claim 5 wherein said keyed lock means includes a plurality of push buttons which must be keyed in a predetermined sequence to deactivate said transmitter.

8. A safety system as claimed in claim 1 wherein after actuation of said receiver means, said link moving means is held in the position where said link element is in the interrupted position;

wherein said receiver means further selectively transmits an enabling signal; and wherein said receiver means further receives said enabling signal and moves said link element back to the functional position.

9. A safety system as claimed in claim 8 wherein said transmitter means includes a plurality of push buttons which must be keyed in a predetermined sequence in order for the transmitter means to transmit the enabling signal.

* * * * *